US008348468B2

(12) United States Patent
Hattori et al.

(10) Patent No.: US 8,348,468 B2
(45) Date of Patent: Jan. 8, 2013

(54) LIGHT EMITTING DEVICE

(75) Inventors: Yasushi Hattori, Kanagawa (JP); Shinji Saito, Kanagawa (JP); Shinya Nunoue, Chiba (JP); Masaki Tohyama, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 43 days.

(21) Appl. No.: 12/876,738

(22) Filed: Sep. 7, 2010

(65) Prior Publication Data

US 2011/0216552 A1 Sep. 8, 2011

(30) Foreign Application Priority Data

Mar. 8, 2010 (JP) ..... 2010-050683

(51) Int. Cl.
*F21V 11/02* (2006.01)

(52) U.S. Cl. ..... 362/291; 362/259; 362/304; 313/501; 313/512; 257/98; 257/99; 257/100; 372/45.013

(58) Field of Classification Search ..... 372/45.013, 372/50.23; 385/123; 257/98–100; 362/259, 362/291, 304; 313/501, 512
See application file for complete search history.

(56) References Cited

U.S. PATENT DOCUMENTS

| | | | | |
|---|---|---|---|---|
| 4,257,672 | A * | 3/1981 | Balliet | 385/35 |
| 7,525,127 | B2 | 4/2009 | Hattori et al. | |
| 7,781,958 | B2 | 8/2010 | Hattori et al. | |
| 2004/0233664 | A1 * | 11/2004 | Beeson et al. | 362/231 |
| 2009/0058256 | A1 | 3/2009 | Mitsuishi et al. | |
| 2009/0185589 | A1 | 7/2009 | Hattori et al. | |
| 2009/0321771 | A1 | 12/2009 | Hattori et al. | |
| 2010/0053970 | A1 | 3/2010 | Sato et al. | |
| 2010/0148203 | A1 | 6/2010 | Hashimoto et al. | |
| 2010/0172388 | A1 * | 7/2010 | Hwang et al. | 372/45.013 |

FOREIGN PATENT DOCUMENTS

| | | |
|---|---|---|
| JP | 57-138378 | 8/1982 |
| JP | 2002-245819 | 8/2002 |
| JP | 2005-108700 | 4/2005 |
| JP | 2007-4203 | 1/2007 |
| JP | 2007-294754 | 11/2007 |
| JP | 3148997 U | 3/2009 |
| JP | 2009-170114 | 7/2009 |

OTHER PUBLICATIONS

English Translation of JP2007-004203, published Jan. 11, 2007.*
U.S. Appl. No. 12/876,675, filed Sep. 7, 2010, Yasushi Hattori, et al.
U.S. Appl. No. 12/874,778, filed Sep. 2, 2010, Shinji Saito, et al.
U.S. Appl. No. 12/729,636, filed Mar. 23, 2010, Yasushi Hattori, et al.
U.S. Appl. No. 13/034,128, filed Feb. 24, 2011, Saito, et al.

(Continued)

*Primary Examiner* — Mary Ellen Bowman
(74) *Attorney, Agent, or Firm* — Oblon, Spivak, McClelland, Maier & Neustadt, L.L.P.

(57) ABSTRACT

An embodiment of the invention provides a light emitting device in which a semiconductor laser diode is used as a light source to emit visible light in a wide range. The light emitting device includes a semiconductor laser diode that emits a laser beam; and a luminescent component that is provided while separated from the semiconductor laser diode and absorbs the laser beam to emit the visible light. In the light emitting device, the luminescent component includes an optical path through which the laser beam is incident to a center portion of the luminescent component.

10 Claims, 9 Drawing Sheets

OTHER PUBLICATIONS

Office Action issued Mar. 21, 2012, in Japanese Patent Application No. 2010-050683 with English translation.

Notification of Reason(s) for Refusal issued Dec. 20, 2011 in Japanese Patent Application No. 2010-050683 (with English translation).

* cited by examiner

LIGHT EMITTING DEVICE

CROSS-REFERENCE TO RELATED APPLICATION

This application is based upon and claims the benefit of priority from Japanese Patent Applications No. 2010-050683, filed on Mar. 8, 2010, the entire contents of which are incorporated herein by reference.

FIELD

Embodiments described herein relate generally to a light emitting device in which a semiconductor laser diode is used as a light source.

BACKGROUND

There have been proposed various light emitting devices in which a semiconductor light emitting element and a luminescent composite are combined. In such light emitting devices, the luminescent composite absorbs excitation light from the semiconductor light emitting element and emits light whose wavelength is different from that of the excitation light.

For example, an LED light bulb in which plural semiconductor diodes (LEDs) are surface-mounted is proposed as the light emitting device.

However, in the LED light bulb, the semiconductor light emitting diodes and a luminescent component are disposed on an opaque substrate that also acts as, a heat sink. Therefore, the rear of the LED light bulb is not illuminated with visible light emitted from the luminescent component because the visible light is obstructed by the light source or a substrate while the front of the LED light bulb is illuminated with the visible light, which causes a problem in that wide-range illumination cannot be realized.

DETAILED DESCRIPTION

Figure 1:
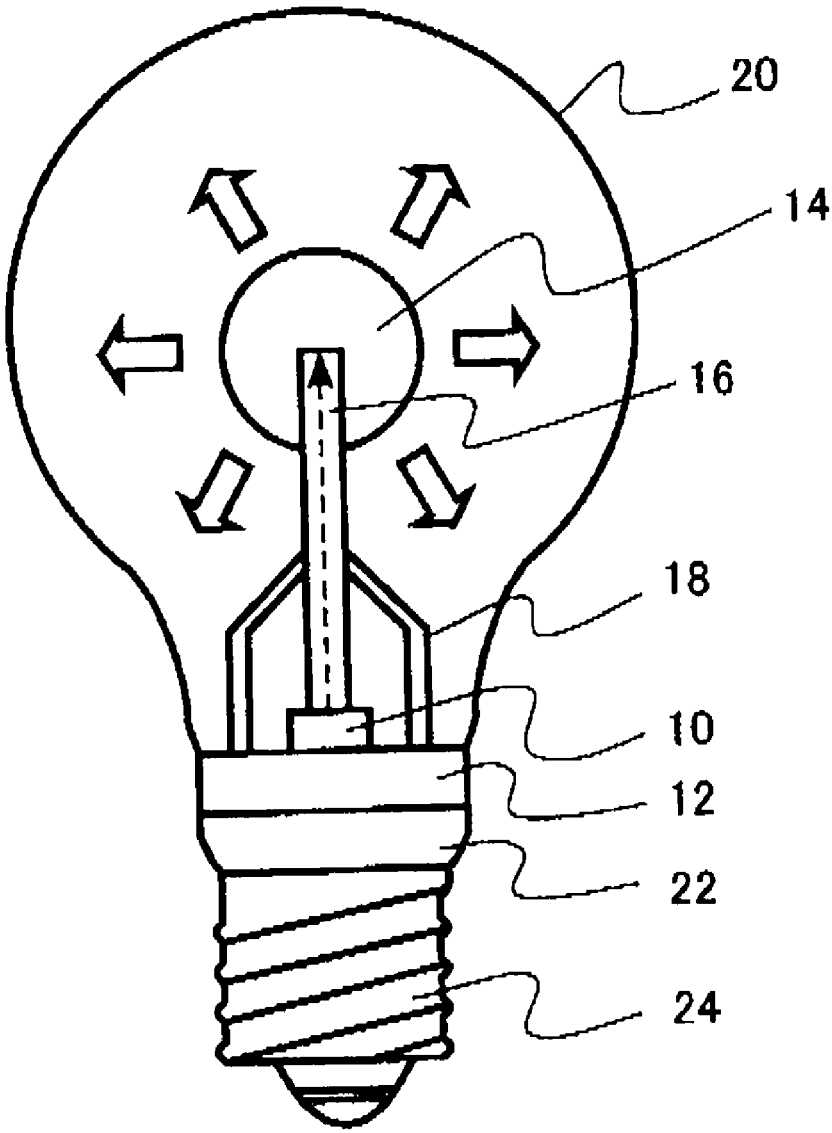
FIG. 1 is a schematic diagram illustrating a light emitting device according to a first embodiment of the invention.

An embodiment of the invention provides a light emitting device in which a semiconductor laser diode is used as a light source to emit visible light in a wide range. The light emitting device includes a semiconductor laser diode that emits a laser beam; and a luminescent component that is provided while separated from the semiconductor laser diode and absorbs the laser beam to emit the visible light. In the light emitting device, the luminescent component includes an optical path through which the laser beam is incident to a center portion of the luminescent component. Embodiments of the invention will be described below with reference to the drawings. In the drawings, the identical or similar part is designated by the identical or similar numeral.

(First Embodiment)

A light emitting device according to a first embodiment of the invention includes a semiconductor laser diode (LD) and a luminescent component. The semiconductor laser diode emits a laser beam. The luminescent component is provided while separated from the semiconductor laser diode, a recess is formed on a laser beam incident position side of the luminescent component, and the luminescent component absorbs the laser beam incident to the recess to emit the visible light. For example, the light emitting device is used as a light bulb (hereinafter also referred to as LD light bulb) with which the incandescent light bulb or the LED light bulb is replaced.

In the light emitting device of the first embodiment, the laser beam having high directivity is used as the light source, thereby separating the light source and the luminescent component from each other. The recess is provided such that the laser beam is incident to a center portion of the luminescent component, whereby the luminescent component emits the light from the center portion. Therefore, the luminescent component can emit the visible light in a wide range of at least 180 degrees.

FIG. 1 is a schematic diagram illustrating a light emitting device according to the first embodiment of the invention. The light emitting device is the LD light bulb with which the incandescent light bulb or the LED light bulb is replaced.

The light emitting device of the first embodiment includes a semiconductor laser diode 10 that emits the laser beam, and the semiconductor laser diode 10 is made of, for example, AlGaInN. The semiconductor laser diode 10 is provided in an upper surface of a substrate 12 while being in contact with the substrate 12. The substrate 12 also acts as a radiator. For example, the substrate 12 is made of metal such as aluminum.

A luminescent component 14 is provided while separated from the semiconductor laser diode 10. The luminescent component 14 is made of a luminescent composite that absorbs the laser beam to emit the visible light, and has a substantially spherical shape. The luminescent component 14 includes the recess on the laser beam incident position side such that the laser beam is desirably incident to the center portion of the luminescent component 14. The recess is provided from the outside of the luminescent component toward the center portion. Desirably the recess reaches to the center portion. As used herein, the center portion means a region at a distance of d/2 or less from the center (where d is a distance from the center (gravity center) of the luminescent component to the outside of the luminescent component).

The light emitting device of the first embodiment includes a light guide component 16 whose leading end is inserted in the recess. In the light guide component 16, for example, a core layer and a cladding layer are formed by a rod-shaped optical fiber made of plastic or quartz glass. In FIG. 1, for example, the cylindrical recess is provided from an outer surface toward the center portion in the luminescent component 14. The luminescent component 14 surrounds the leading end of the light guide component 16 constituting an optical path through which the laser beam propagates. The leading end of the light guide component 16 is formed so as to be located in the center portion of the luminescent component 14. The light guide component 16 is supported by a brace 18 that extends from the substrate 12. The shape of the recess is not limited to the cylindrical shape, but the recess may be formed into a quadratic prism shape, a conical shape, a polygonal pyramid shape, and the like.

A transparent glass or plastic cover 20 is attached to the substrate 12 to cover the semiconductor laser diode 10 and the luminescent component 14 therewith. The cover 20 is formed into a spherical shape and has a function of protecting the semiconductor laser diode 10 and the luminescent component 14 therein. For example, in order to prevent degradation of the semiconductor laser diode 10 or the luminescent component 14 owing to contact with air, the inside of the cover 20 may be evacuated, or be sealed with an argon gas included therein.

An insulating component 22 made of, for example, a synthetic resin is attached onto the opposite side to the cover 20 of the substrate 12. A base 24 is formed below the insulating component 22. For example, a control circuit for the semiconductor laser diode 10 is provided in the substrate 12. For example, the base 24 and the control circuit are electrically connected through wiring provided in the insulating component 22.

Desirably the semiconductor laser diode 10 has an emission peak wavelength in a blue to ultraviolet wavelength region of 430 nm or less from the standpoint of efficient generation of white light.

Figure 2:
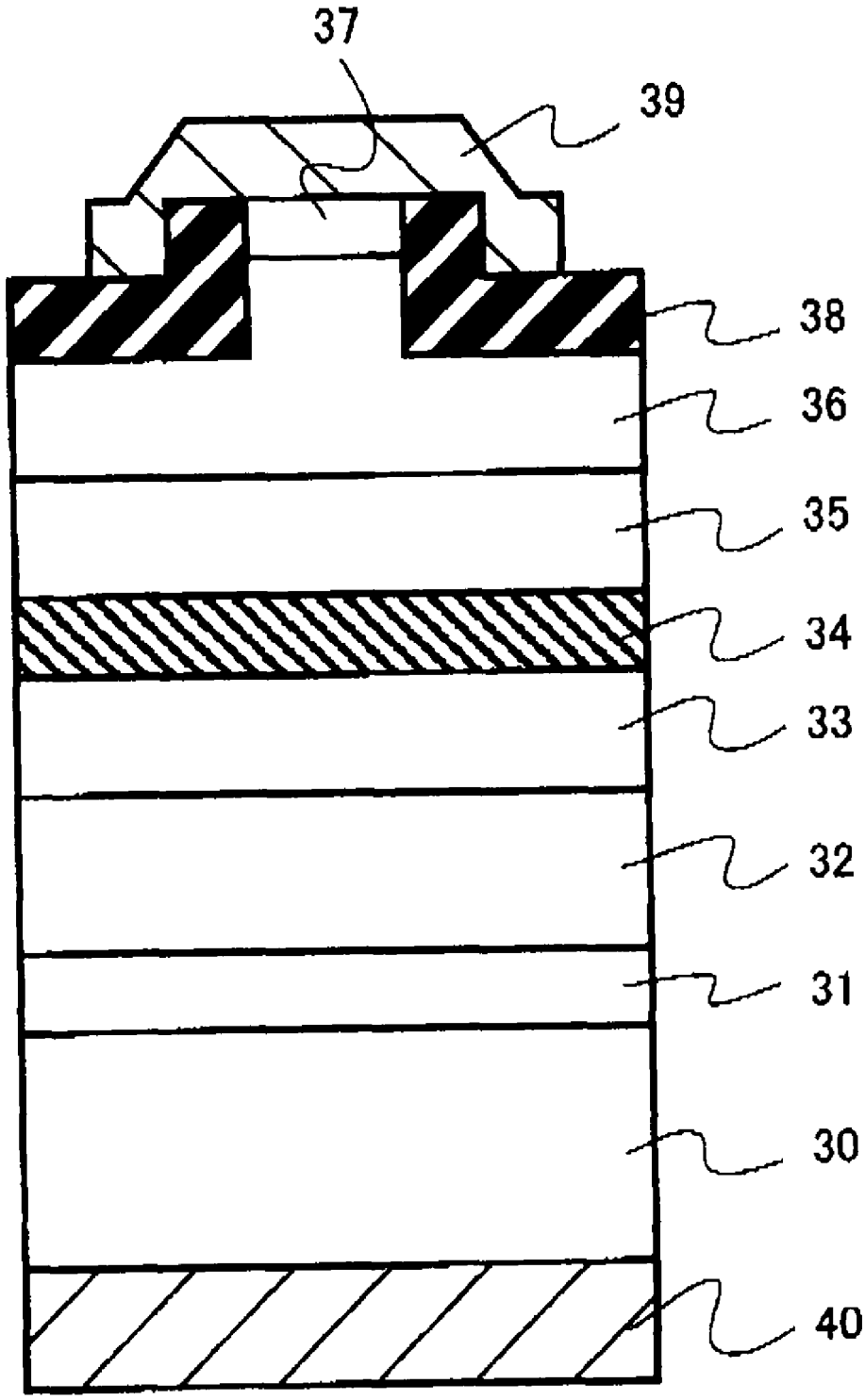
FIG. 2 is a sectional view illustrating a first specific example of a semiconductor laser diode.

FIG. 2 is a sectional view illustrating a first specific example of the semiconductor laser diode. The semiconductor laser diode is an edge emitting AlGaInN laser diode in which GaInN that is a III-V compound semiconductor is used as a light emitting layer.

The semiconductor laser diode has a structure in which an n-type GaN buffer layer 31, an n-type AlGaN cladding layer 32, an n-type GaN optical guide layer 33, a GaInN light emitting layer 34, a p-type GaN optical guide layer 35, a p-type AlGaN cladding layer 36, and a p-type GaN contact layer 37 are sequentially stacked on an n-type GaN substrate 30. Insulating films 38 are provided on a ridge side surface of the p-type GaN contact layer 37 and a surface of the p-type AlGaN cladding layer 36. A p-side electrode 39 is provided on surfaces of the p-type GaN contact layer 37 and the insulating film 38, and an n-side electrode 40 is provided on a rear surface of the n-type GaN substrate 30. The laser beam is emitted from the GaInN light emitting layer 34 by applying an operating voltage between the p-side electrode 39 and the n-side electrode 40.

Figure 3:
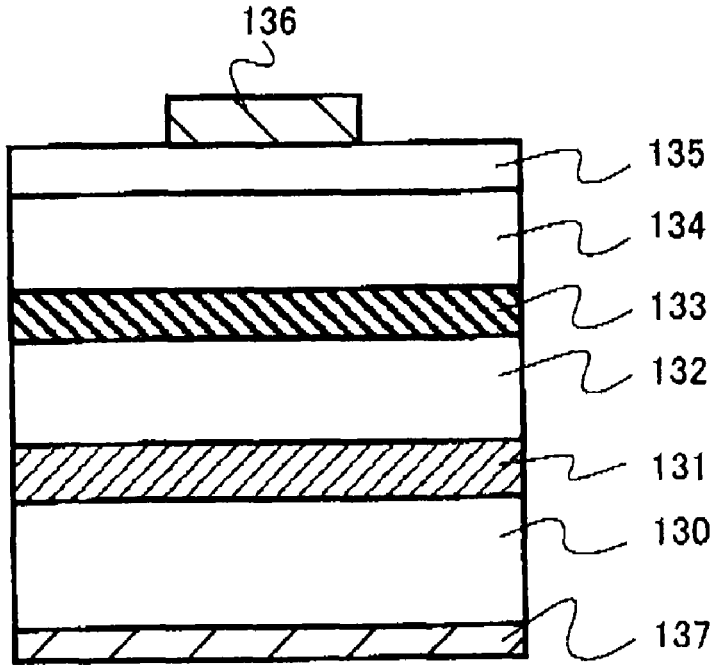
FIG. 3 is a sectional view illustrating a second specific example of the semiconductor laser diode.

FIG. 3 is a sectional view illustrating a second specific example of the semiconductor laser diode. The semiconductor laser diode is an edge emitting MgZnO laser diode in which MgZnO that is a II-VI compound semiconductor is used as the light emitting layer.

The semiconductor laser diode has a structure in which a metallic reflecting layer 131, a p-type MgZnO cladding layer 132, an i-type MgZnO light emitting layer 133, an n-type MgZnO cladding layer 134, and an n-type MgZnO contact layer 135 are sequentially stacked on a zinc oxide (ZnO) substrate 130. An n-side electrode 136 is provided in the n-type contact layer 135. A p-side electrode 137 is provided on the substrate 130.

Figure 4:
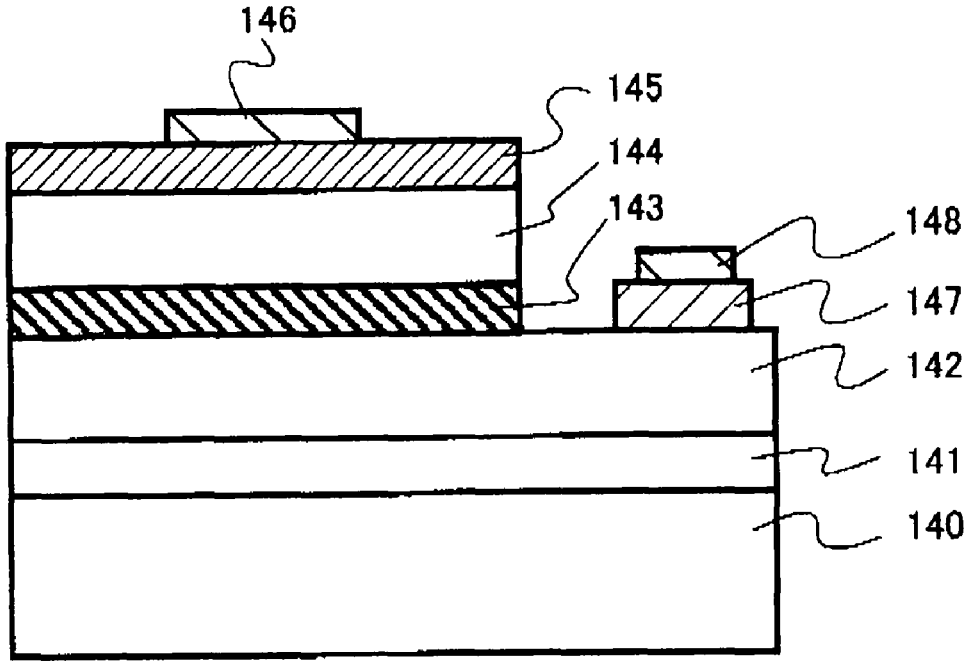
FIG. 4 is a sectional view illustrating a third specific example of the semiconductor laser diode.

FIG. 4 is a sectional view illustrating a third specific example of the semiconductor laser diode. The semiconductor laser diode is also the edge emitting MgZnO laser diode in which MgZnO that is the II-VI compound semiconductor is used as the light emitting layer.

The semiconductor laser diode has a structure in which a ZnO buffer layer 141, a p-type MgZnO cladding layer 142, a MgZnO light emitting layer 143, and an n-type MgZnO cladding layer 144 are sequentially stacked on a Si substrate 140. An n-side electrode 146 is provided on the n-type cladding layer 144 with an Indium Tin Oxide (ITO) electrode layer 145 interposed therebetween. A p-side electrode 148 is provided on the p-type cladding layer 142 with an ITO electrode layer 147 interposed therebetween.

Figure 5:
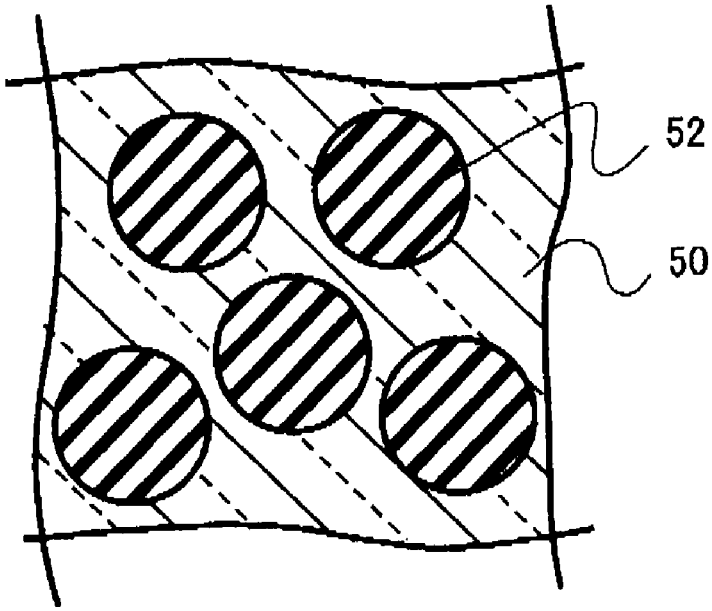
FIG. 5 is an enlarged sectional view illustrating an example of a luminescent component used in the first embodiment.

FIG. 5 is an enlarged sectional view illustrating an example of the luminescent component used in the first embodiment. For example, the luminescent component is made of a luminescent composite in which phosphor particles 52 are dispersed in a transparent base material 50. The laser beam that is the excitation light incident to the luminescent component is absorbed by the phosphor particles 52 and converted into the visible light whose wavelength is different from that of the excitation light.

Desirably a transparent resin, inorganic glass, or a crystal is used as the transparent base material 50.

A content of the phosphor particle 52 in the transparent base material 50 may be adjusted such that the excitation light from the semiconductor laser diode is effectively absorbed and transmitted. Desirably the phosphor particle 52 has a particle diameter ranging from 5 to 25 μm. Particularly the phosphor particles including particles having large diameters of about 20 μm or more are desirably used because of high emission intensity and high luminous efficiency. When the particle diameter of the phosphor particle 52 is lower than 5 μm, the phosphor particle is not suitable to the luminescent component because of a low absorption factor of the luminescent component and easy degradation of the luminescent component. When the particle diameter of the phosphor particle exceeds 25 μm, the luminescent component is hardly formed, and color unevenness is easily generated.

According to experiments performed by the inventors, it is found that a certain relationship exists between a thickness of the luminescent component and a concentration (weight of phosphor/weight of luminescent component) of the phosphor in the luminescent component. That is, in the excitation light from the semiconductor laser diode, intensity I of the light (that is not used as emission light) that is not absorbed by the phosphors can be expressed by the following equation:

$$I=I_0e^{\kappa ct}$$

$I_0$: intensity of excitation light

κ: coefficient c: concentration (weight) of phosphor in luminescent component t: thickness of luminescent component (μm)

Figure 6:
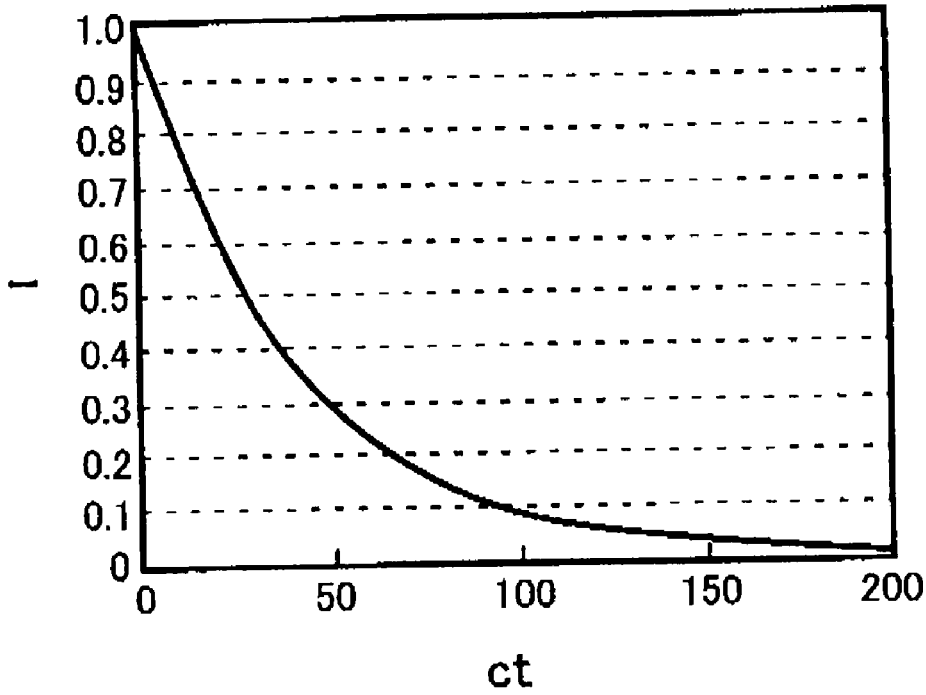
FIG. 6 is a graph in which a horizontal axis indicates ct while a vertical axis indicates I.

FIG. 6 is a graph in which a horizontal axis indicates ct while a vertical axis indicates I. As is clear from the graph of FIG. 6, in order to reduce the light that is not absorbed by the phosphors as little as possible, it is necessary to optimize a concentration of the phosphor according to the size of the required luminescent component.

The phosphor can be used as a blue luminescent component, a yellow luminescent component, a green luminescent component, a red luminescent component, and a white luminescent component by appropriately selecting the material. The luminescent component that emits light having an intermediate color can be formed by combining plural kinds of phosphor. The white luminescent component may be formed by combining phosphors having colors corresponding to red, green, and blue (RGB) that are three primary colors of the light, or by combining colors having a complementary color relationship like blue and yellow.

In the combinations, the luminescent composite in which plural kinds of the phosphors are mixed may be used as one luminous body, the plural kinds of the luminescent composites may be formed into a laminar structure in which the luminescent composites are stacked layer by layer in one luminescent component, or the plural kinds of the luminescent composites may be provided while divided into regions.

For example, the light emitting device in which the luminescent component emits the white light is obtained when the RGB phosphors are mixed in the transparent base material. For example, the luminescent composites including the phosphors having the colors corresponding to the RGB color are formed as layers corresponding to the RGB colors in the luminescent component, thereby obtaining the light emitting device that emits the white light. When the white luminescent component is formed, in order to obtain the efficiency and stability of coloring, desirably each luminescent composite layer or each region of the luminescent component includes one kind of the phosphor, and the white color is formed by the whole of the luminescent component.

When the laminar luminescent component is formed, desirably the luminescent composite that emits the light having a longer wavelength is disposed close to the light guide component in the center of the luminescent component. When the luminescent component is formed from the viewpoint of the simple production, desirably the plural kinds of the phosphors are mixed to form one luminescent composite.

Figure 7:
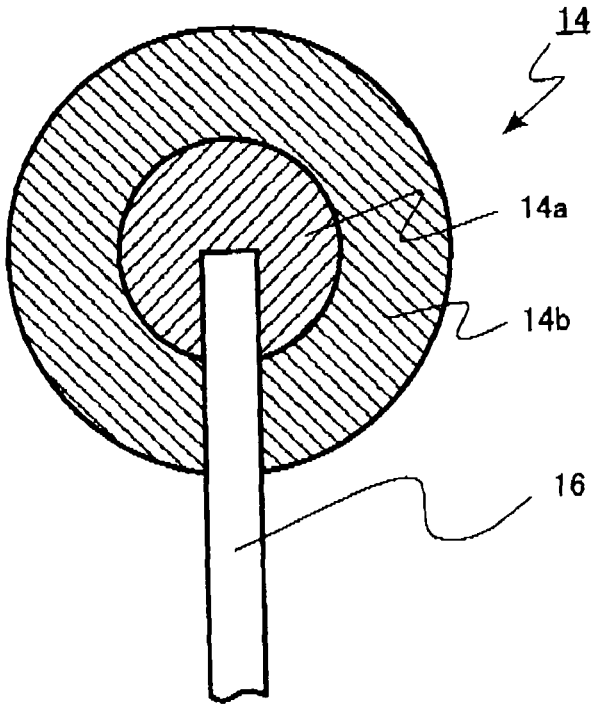
FIG. 7 illustrates an example of the luminescent component in the light emitting device of the first embodiment.

FIG. 7 illustrates an example of the luminescent component in the light emitting device of the first embodiment. The luminescent component 14 of FIG. 7 has a structure in which two luminescent composites are coaxially stacked into the spherical shape. In FIG. 7, the inside luminescent composite is a yellow luminescent composite 14*a* containing yellow phosphors, and the outside luminescent composite is a blue luminescent composite 14*b* containing blue phosphors.

For example, a silicone resin is used as the transparent base material for each of the yellow luminescent composite 14*a* and the blue luminescent composite 14*b*. Specifically, for example, $(Sr, Ca, Ba)_2Si_2O_4$:Eu is used as the yellow phosphor of the yellow luminescent composite 14*a*, and $(Sr, Ca, Ba)_{10}(PO_4)_6Cl_2$: Eu is used as the blue phosphor of the blue luminescent composite 14*b*.

The yellow luminescent composite 14*a* that emits the light whose wavelength is longer than that of the blue luminescent composite 14*b* is disposed close to the light guide component 16, whereby reabsorption of the light is suppressed among luminescent composites to efficiently obtain the light emitting device that emits the white light.

Figure 8:
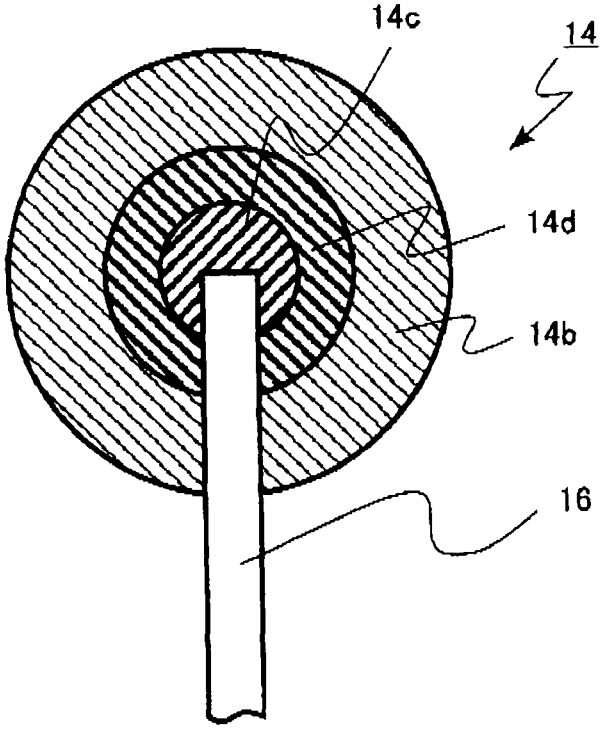
FIG. 8 illustrates another example of the luminescent component in the light emitting device of the first embodiment.

FIG. 8 illustrates another example of the luminescent component in the light emitting device of the first embodiment. The luminescent component 14 of FIG. 8 has a structure in which three luminescent composites are coaxially stacked into the spherical shape. In FIG. 8, the inside luminescent composite is a red luminescent composite 14*c* containing red phosphors. The intermediate luminescent composite is a green luminescent composite 14*d* containing green phosphors, and the outside luminescent composite is the blue luminescent composite 14*b* containing the blue phosphors.

The red luminescent composite 14*c* that emits the light having the longest wavelength is disposed in the center, the green luminescent composite 14*d* that emits the light having the second longest wavelength is disposed outside the red luminescent composite 14*c*, and the blue luminescent composite 14*b* that emits the light having the shortest wavelength is disposed outermost. Therefore, the light absorption is suppressed in the luminescent component 14 to obtain the light emitting device that efficiently emits the white light.

Figure 9:
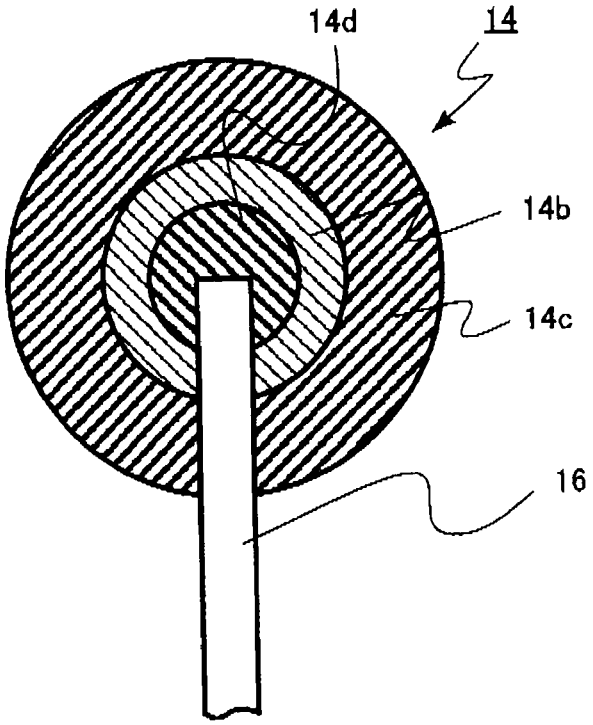
FIG. 9 illustrates still another example of the luminescent component in the light emitting device of the first embodiment.

FIG. 9 illustrates still another example of the luminescent component in the light emitting device of the first embodiment. The luminescent component 14 of FIG. 9 has a structure in which three luminescent composites are coaxially stacked into the spherical shape. In FIG. 9, the inside luminescent composite is the green luminescent composite 14*d* containing the green phosphors. The intermediate luminescent composite is the blue luminescent composite 14*b* containing the blue phosphors, and the outside luminescent composite is the red luminescent composite 14*c* containing the red phosphors.

Specifically, for example, $(Sr, Ca, Ba)_2Si_2O_4$:Eu, $(Sr, Ca, Ba)_{10}(PO_4)_6Cl_2$:Eu, and $La_2O_2S$:Eu are used as the green phosphor, the blue phosphor, and the red phosphor, respectively.

Because the red luminescent composite does not reabsorbs the blue light and green light, the luminous efficiency is degraded even if the red luminescent composite is disposed outside. On the other hand, the green luminescent composite having the high absorption factor of the laser beam and the high luminous efficiency constitutes a lower layer, so that the return of the excitation light to the light guide component side, caused by the reflection and scattering, can be reduced to implement the structure having the high luminous efficiency.

In forming the luminescent component having the stacked structure of the luminescent composites, a determination whether the layer that emits the light having the longer wavelength is located inside as illustrated in FIG. 8 or outside as illustrated in FIG. 9 may be made such that the optimum luminous efficiency is obtained, in consideration of the kinds of selected phosphors, the thickness and concentration of each layer, and the coloring of the visible light.

In the first embodiment, the semiconductor laser diode that emits the laser beam having the high directivity is used as the light source, so that the light source and the luminescent component can be separated from each other. Therefore, the light source and the substrate and radiator member, which are provided while being in contact with the light source, can be prevented from obstructing the visible light emitted from the luminescent component. The use of the light guide component formed by the optical fiber as the optical path suppresses the spread of the laser beam to enhance the directivity, thereby reducing energy loss.

The semiconductor laser diode is smaller than the semiconductor diode in a chip area per optical output. Therefore, because the heat generation portion becomes reduced in size, the radiator member can be miniaturized, which advantageously suppresses the obstruction of the visible light due to the radiator member and the like.

It is assumed that the laser beam is directly incident to the outer surface of the luminescent component 14 because the recess is not provided from the outside toward the center portion in the luminescent component 14, for example. At this point, the light emission is strengthened near the laser beam incident position of the luminescent component 14, that is, on the side of the semiconductor laser diode 10 of the luminescent component 14, and the emission intensity is relatively weakened on the opposite side to the incident position of the luminescent component 14 because the laser beam or the visible light is absorbed in the luminescent component 14. Accordingly, luminescence intensity of the visible light emitted from the LD light bulb has a strongly uneven distribution in which the luminescence intensity is strengthened toward the laser beam incident position side (downward direction in FIG. 1) while weakened toward the opposite side (upward direction in FIG. 1).

On the other hand, in the first embodiment, because the recess is provided in the luminescent component 14 such that the laser beam is incident to the center portion of the luminescent component, the laser beam indicated by an arrow of a dotted line in FIG. 1 is incident to the center portion of the luminescent component 14. Therefore, the light is emitted in the center portion of the luminescent component 14. Then the laser beam scattered in the center portion or the generated visible light diffuses to the outside of the luminescent component 14.

Accordingly, because the laser beam or the visible light is isotropically absorbed by the luminescent component 14 until the visible light goes out of the luminescent component 14, the distribution of the luminescence intensity of the visible light becomes even as indicated by a white arrow in FIG. 1, and the highly even visible light can be emitted in the wide range.

(Second Embodiment)

A light emitting device according to a second embodiment of the invention is similar to that of the first embodiment except that a light diffusion composite is provided in the center portion of the luminescent component. Accordingly, contents overlapping those of the first embodiment are omitted.

Figure 10:
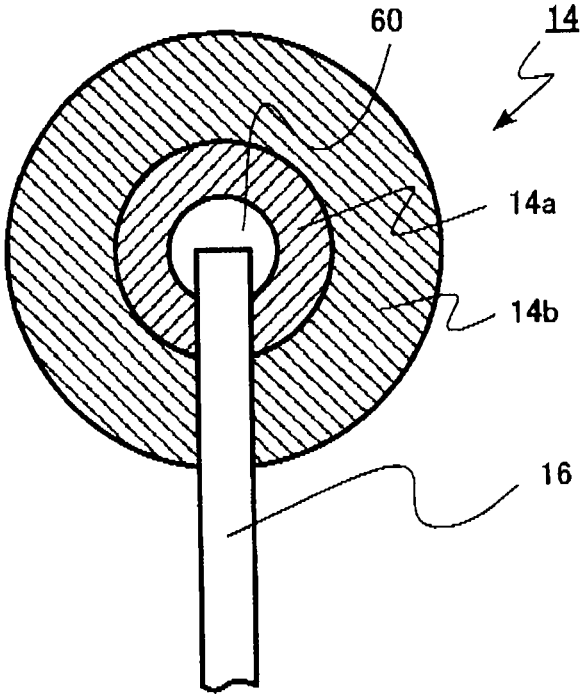
FIG. 10 illustrates an example of a luminescent component in a light emitting device according to a second embodiment of the invention.

FIG. 10 illustrates an example of the luminescent component in the light emitting device of the second embodiment. The luminescent component 14 of FIG. 10 has a structure in which two luminescent composites are coaxially stacked into the spherical shape. In FIG. 10, the inside luminescent composite is the yellow luminescent composite 14*a* containing the yellow phosphors, and the outside luminescent composite is the blue luminescent composite 14*b* containing the blue phosphors.

A light diffusion composite 60 is provided such that the light guide component 16 that is the optical path of the laser beam is covered the light diffusion composite 60 in the center portion. The light diffusion composite 60 contains white particles having functions of scattering the laser beam. For example, $BaSO_4$, MgO, $TiO_2$, $Al_2O_3$, ZnO, and $SiO_2$ can be used as the white particle.

In the second embodiment, the laser beam incident through the recess is extremely isotropically scattered in the center portion of the luminescent component 14 by the light diffusion composite 60. Accordingly, the evenness of the luminescence intensity distribution of the visible light is further improved, and the highly even visible light can be emitted in the wide range.

Figure 11:
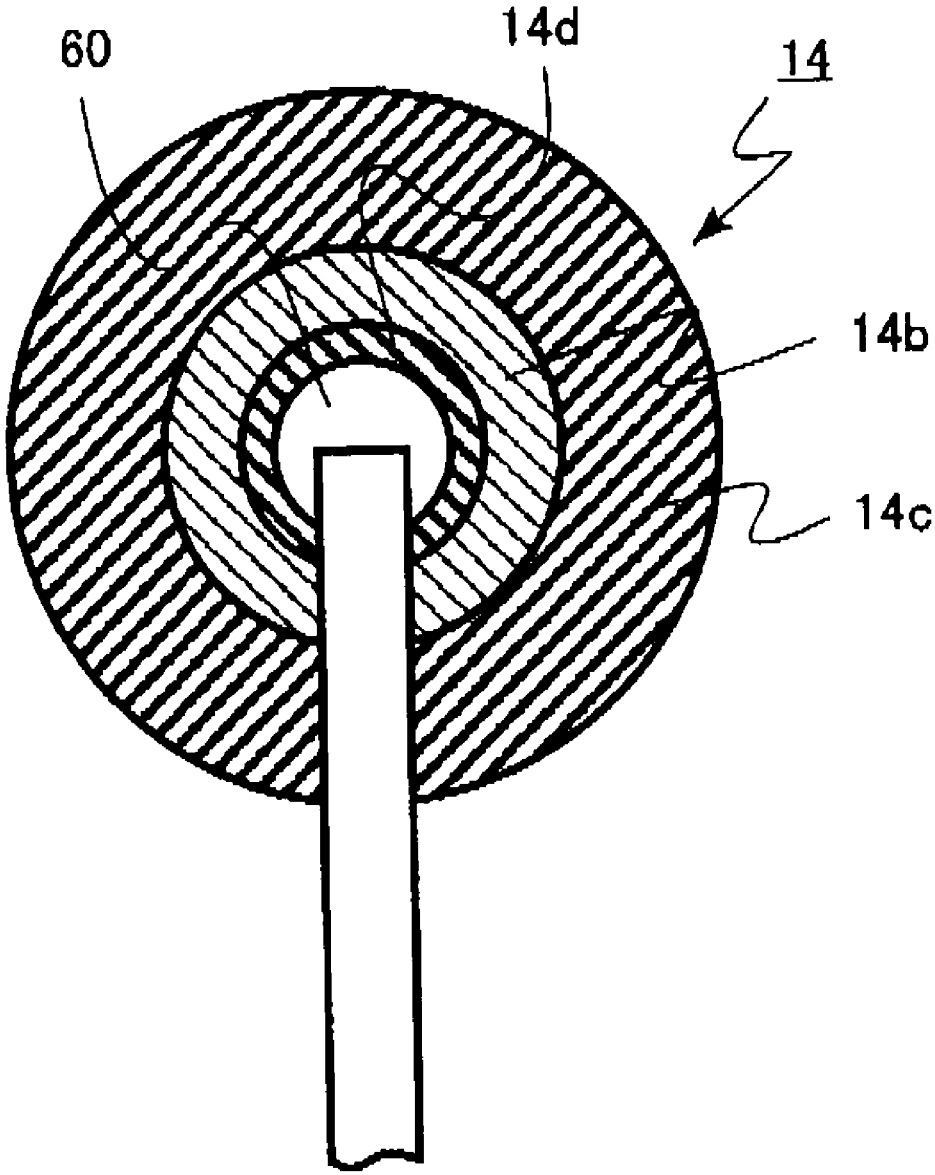
FIG. 11 illustrates another example of the luminescent component in the light emitting device of the second embodiment.

FIG. 11 illustrates another example of the luminescent component in the light emitting device of the second embodiment. The luminescent component 14 of FIG. 11 has a structure in which three luminescent composites are coaxially stacked into the spherical shape. In FIG. 11, the inside luminescent composite is the green luminescent composite 14*d* containing the green phosphors, the intermediate luminescent composite is the blue luminescent composite 14*b* containing the blue phosphors, and the outside luminescent composite is the red luminescent composite 14*c* containing the red phosphors.

The light diffusion composite 60 is provided in the center portion. In the luminescent component of FIG. 11, the evenness of the luminescence intensity distribution of the visible light is further improved, and the highly even visible light can be emitted in the wide range.

(Third Embodiment)

In a light emitting device according to a third embodiment of the invention, the light guide component is not inserted in the recess, the recess constitutes a cavity, and an optical lens is provided between the semiconductor laser diode and the luminescent component in order to collect the laser beam. Because other configurations are basically similar to those of the first embodiment, contents overlapping those of the first embodiment are omitted.

Figure 12:
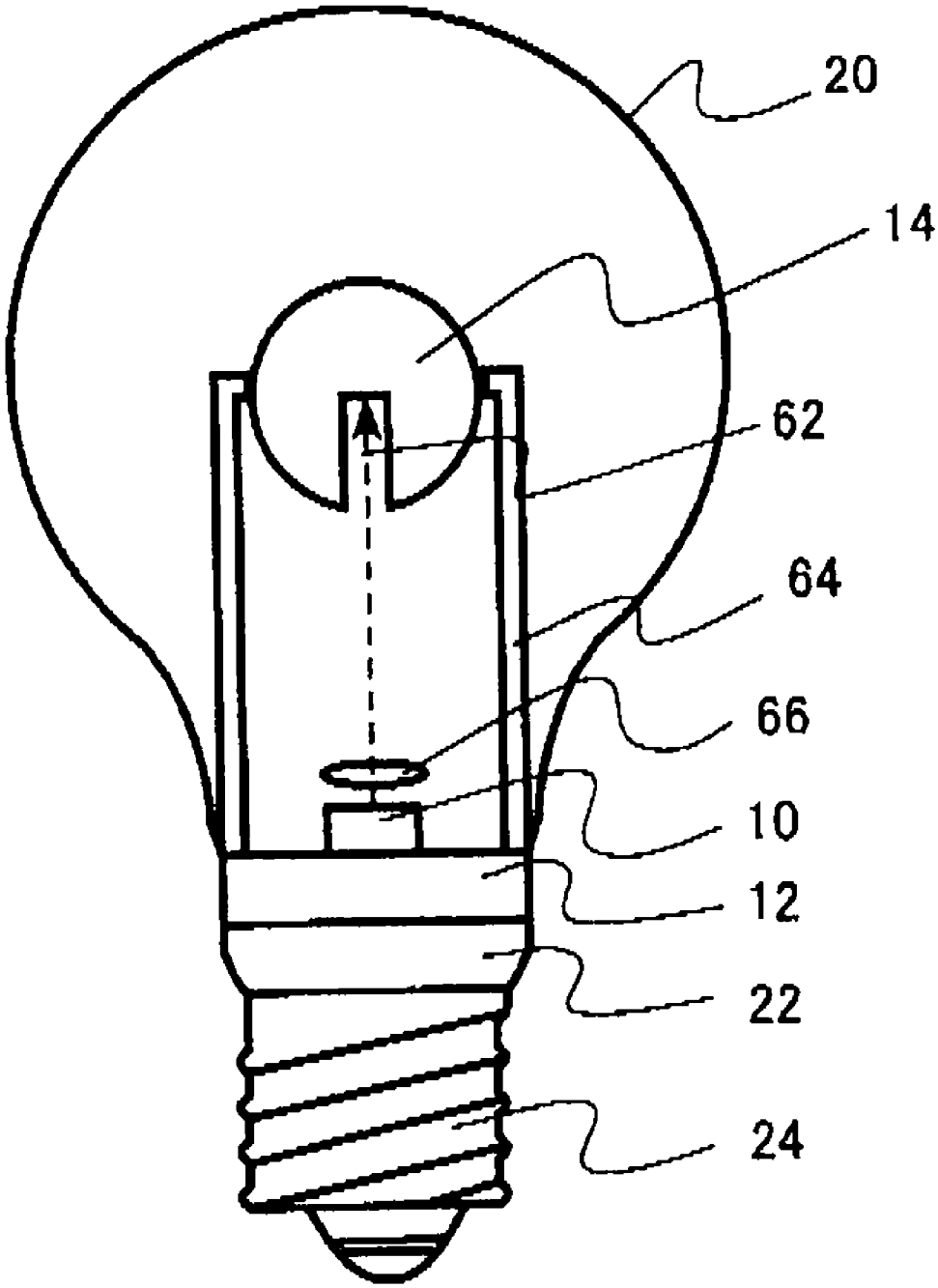
FIG. 12 is a schematic diagram illustrating a light emitting device according to a third embodiment of the invention.

FIG. 12 is a schematic diagram illustrating the light emitting device of the third embodiment. In the luminescent component 14, for example, a cylindrical recess is formed toward the center from the outside of the luminescent component 14 such that the laser beam is incident to the center portion of the luminescent component 14, thereby constituting a cavity 62. The cavity 62 becomes the optical path of the laser beam. In FIG. 12, the leading end of the cavity 62 that becomes the optical path is formed so as to be located in the center portion of the luminescent component 14.

The luminescent component 14 is supported by a brace 64 that extends from the substrate 12. An optical lens 66 that collects the laser beam to control the spread of the laser beam is provided between the semiconductor laser diode 10 and the luminescent component 14. For example, the optical lens 66 is supported by a brace (not illustrated) that extends from the substrate 12.

In the third embodiment, similarly to the first embodiment, the evenness of the luminescence intensity distribution of the visible light is improved, and the highly even visible light can be emitted in the wide range. Because the light guide component is not provided, advantageously the energy loss of the laser beam, caused by the absorption and scattering, is not generated in the light guide component. Further, because the light guide component is not provided, advantageously the light emitting device can be produced with the simpler configuration.

(Fourth Embodiment)

A light emitting device according to a fourth embodiment of the invention includes the optical lens that collects the laser beam between the semiconductor laser diode and the luminescent component. Because other configurations are basically similar to those of the first embodiment, contents overlapping those of the first embodiment are omitted.

Figure 13:
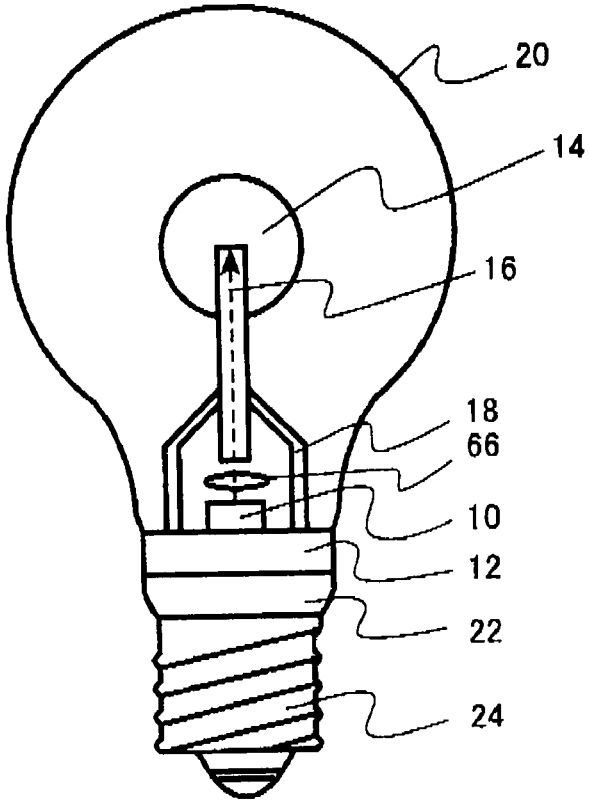
FIG. 13 is a schematic diagram illustrating a light emitting device according to a fourth embodiment of the invention.

FIG. 13 is a schematic diagram illustrating the light emitting device of the fourth embodiment. The optical lens 66 that collects the laser beam between the semiconductor laser diode 10 and the luminescent component 14, more particularly between the semiconductor laser diode 10 and the light guide component 16. For example, the optical lens 66 is supported by the brace (not illustrated) that extends from the substrate 12.

In the fourth embodiment, similarly to the first embodiment, the evenness of the luminescence intensity distribution of the visible light is further improved, and the highly even visible light can be emitted in the wide range. Because the optical lens 62 collects the laser beam, the spread of the laser beam is further suppressed to enhance the directivity, which allows the reduction of the energy loss.

(Fifth Embodiment)

A light emitting device according to a fifth embodiment of the invention is one in which a member such as the cover with which the luminescent component is covered is not provided.

The configurations are basically similar to those of the first embodiment except that the light emitting device of the fifth embodiment does not have the electric bulb shape. Accordingly, contents overlapping those of the first embodiment are omitted.

Figure 14:
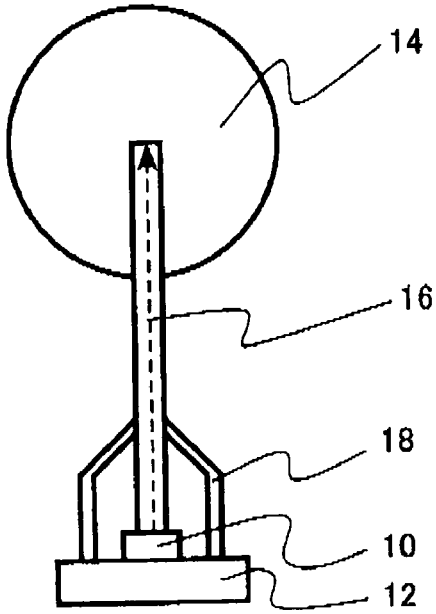
FIG. 14 is a schematic diagram illustrating a light emitting device according to a fifth embodiment of the invention.

FIG. 14 is a schematic diagram illustrating the light emitting device of the fifth embodiment. As illustrated in FIG. 14, in the fifth embodiment, the member with which the luminescent component 14 is covered is not provided, but the luminescent component 14 is exposed.

According to the configuration of the fifth embodiment, the light emitting device that emits the highly even visible light in the wide range is implemented by the extremely simple mode.

Desirably the size of the luminescent component 14 is larger than that of the semiconductor laser diode 10 or substrate 12 such that the semiconductor laser diode 10 or substrate 12 does not become the obstruction of the visible light emitted from the luminescent component 14.

While certain embodiments have been described, these embodiments have been presented by way of example only, and are not intended to limit the scope of the inventions. Indeed, the light emitting device described herein may be embodied in a variety of other forms; furthermore, various omissions, substitutions and changes in the form of the devices and methods described herein may be made without departing from the spirit of the inventions. The accompanying claims and their equivalents are intended to cover such forms or modifications as would fall within the scope and spirit of the inventions.

For example, in the embodiments, the luminescent component is formed into the substantially spherical shape. Alternatively, shapes such as an oval sphere, a cubic, a rectangular solid, a polyhedron, and cylindrical shape may be selected according to the necessary illumination distribution.

The shape of the cover is not limited to the spherical shape, but the cover may be formed into another shape.

In the embodiments, the light guide component is formed by the optical fiber. Although the optical fiber is desirably used in order to reduce the optical loss or to form the light guide component into a curved shape, it is not always necessary that the light guide component be formed by the optical fiber. For example, the light guide component may be simply formed by a plastic rod or a glass rod.

The AlGaInN laser diode in which the light emitting layer is made of GaInN is used in the embodiments. Aluminum nitride/gallium nitride/indium nitride (AlGaInN) that is a III-V compound semiconductor or magnesium oxide/zinc oxide (MgZnO) that is a II-VI compound semiconductor can be used as the light emitting layer (active layer). For example, the III-V compound semiconductor used as the light emitting layer is a nitride semiconductor that contains at least one element selected from a group consisting of Al, Ga, and In. Specifically the nitride semiconductor is expressed by $Al_xGa_yIn_{(1-x-y)}N$ ($0 \leqq x \leqq 1$, $0 \leqq y \leqq 1$, $0 \leqq (x+y) \leqq 1$). The nitride semiconductor includes binary semiconductors such as AlN, GaN, and InN, ternary semiconductors such as $Al_xGa_{(1-x)}N$ ($0<x<1$), $Al_xIn_{(1-x)}N$ ($0<x<1$), and $Ga_yIn_{(1-y)}N$ ($0<y<1$), and quaternary semiconductors including all the elements. The emission peak wavelength is determined in the range of ultraviolet to blue based on compositions x, y, and (1−x−y) of Al, Ga, and In. Part of the III-group element can be substituted for boron (B), thallium (Tl), and the like. Part of N that is the V-group element can be substituted for phosphorous (P), arsenic (As), antimony (Sb), bismuth (Bi) and the like.

Similarly, an oxide semiconductor containing at least one of Mg and Zn can be used as the II-VI compound semiconductor that is used as the light emitting layer. Specifically, the oxide semiconductor expressed by $Mg_zZn_{(1-z)}O$ ($0 \leqq z \leqq 1$) is used as the II-VI compound semiconductor, and the emission peak wavelength in the ultraviolet region is determined based on compositions z and (1−z) of Mg and Zn.

The silicone resin is used as the transparent base material of the luminescent composite in the embodiments. Alternatively, any material having the high permeability of the excitation light and a high heat-resistant property may be used as the transparent base material. In addition to silicone resin, examples of the material include an epoxy resin, a urea resin, a fluorine resin, an acrylic resin, and a polyimide resin. Particularly the epoxy resin or the silicone resin is suitably used because of easy availability, easy handling, and low cost. A ceramic structure in which glass, a sintered body, or Yttrium Aluminum Garnet (YAG) and alumina ($Al_2O_3$) are combined may be used in addition to the resins.

The phosphor is made of a material that absorbs the light having the wavelength region of ultraviolet to blue to emit the visible light. For example, phosphors such as a silicate phosphor, an aluminate phosphor, a nitride phosphor, a sulfide phosphor, an oxysulfide phosphor, a YAG phosphor, a borate phosphor, a phosphate-borate phosphor, a phosphate phosphor, and a halophosphate phosphor can be used. The compositions of the phosphors are shown below.

(1) Silicate phosphor: $(Sr_{(1-x-y-z)}Ba_xCa_yEu_z)_2Si_wO_{(2+2w)}$ ($0 \leqq x \leqq 1$, $0 \leqq y<1$, $0.05 \leqq x \leqq 0.2$, and $0.90 \leqq w \leqq 1.10$)

The compositions of x=0.19, y=0, z=0.05, and w=1.0 is desirable in the silicate phosphor expressed by the chemical formula. In order to stabilize the crystal structure or enhance the emission intensity, part of strontium (Sr), barium (Ba), and calcium (Ca) may be substituted for at least one of Mg and Zn. For example, $MSiO_3$, $MSiO_4$, $M_2SiO_3$, $M_2SiO_5$, and $M_4Si_2O_8$ (M is at least one element that is selected from a group consisting of Sr, Ba, Ca, Mg, Be, Zn, and Y) can be used as the silicate phosphor having another composition ratio. In order to control the emission color, part of Si may be substituted for germanium (Ge) (for example, $(Sr_{(1-x-y-z)}Ba_xCa_yEu_z)_2(Si_{(1-u)}Ge_u)O_4$). At least one element that is selected from a group consisting of Ti, Pb, Mn, As, Al, Pr, Tb, and Ce may be contained as the activation agent.

(2) Aluminate phosphor: $M_2Al_{10}O_{17}$ (where M is at least one element that is selected from a group consisting of Ba, Sr, Mg, Zn, and Ca)

At least one element of Eu and Mn is contained as the activation agent. For example, $MAl_2O_4$, $MAl_4O_{17}$, $MAl_8O_{13}$, $MAl_{12}O_{19}$, $M_2Al_{19}O_{17}$, $M_2Al_{11}O_{19}$, $M3A_{15}O_{12}$, $M_3Al_{15}O_{12}$, $M_3Al_{16}O_{27}$, and $M_4Al_5O_{12}$ (M is at least one element that is selected from a group consisting of Ba, Sr, Ca, Mg, Be, and Zn) can be used as the aluminate phosphor having another composition ratio. At least one element that is selected from a group consisting of Mn, Dy, Tb, Nd, and Ce may be contained as the activation agent.

(3) Nitride phosphor (mainly silicon nitride phosphor): $L_xSi_yN_{(2x/3+4y/3)}$:Eu or $L_xSi_yO_zN_{(2x/3+4y/3-2z/3)}$:Eu (L is at least one element that is selected from a group consisting of Sr, Ca, Sr, and Ca)

Although the compositions of x=2 and y=5 or x=1 and y=7 are desirable, x and y can be set to arbitrary values. Desirably phosphors such as $(Sr, Ca_{(1-x)})_2Si_5N_8$:Eu, $Sr_2Si_5N_8$:Eu, $Ca_2Si_5N_8$:Eu, $Sr_xCa_{(1-x)}Si_7N_{10}$:Eu, $SrSi_7N_{10}$:Eu, and $CaSi_7N_{10}$:Eu in which Mn is added as the activation agent are used as the nitride phosphor expressed by the chemical formulas. The phosphors may contain at least one element that is selected from a group consisting of Mg, Sr, Ca, Ba, Zn, B, Al, Cu, Mn, Cr, and Ni. At least one element that is selected from a group consisting of Ce, Pr, Tb, Nd, and La may be contained as the activation agent.

(4) Sulfide phosphor: $(Zn_{(1-x)}Cd_x)S:M$ (M is at least one element that is selected from a group consisting of Cu, Cl, Ag, Al, Fe, Cu, Ni, and Zn, and x is a numerical value satisfying $0 \leqq x \leqq 1$)

S may be substituted for at least one of Se and Te.

(5) Oxysulfide phosphor: $(Ln_{(1-x)}Eu_x)\ O_2S$ (Ln is at least one element that is selected from a group consisting of Sc, Y, La, Gd, and Lu, and x is a numerical value satisfying $0 \leqq x \leqq 1$)

At least one element that is selected from a group consisting of Tb, Pr, Mg, Ti, Nb, Ta, Ga, Sm, and Tb may be contained as the activation agent.

(6) YAG phosphor: $(Y_{(1-x-y-z)}Gd_xLa_ySm_z)_3(Al_{(1-v)}\ Ga_v)_5\ O_{12}$: Ce, Eu ($0 \leqq x \leqq 1$, $0 \leqq y \leqq 1$, $0 \leqq z \leqq 1$, $0 \leqq v \leqq 1$)

At least one of Cr and Tb may be contained as the activation agent.

(7) Borate phosphor: $MBO_3$:Eu (M is at least one element that is selected from a group consisting of Y, La, Gd, Lu, and In)

Tb may be contained as the activation agent. For example, $Cd_2B_2O5_5$:Mn, (Ce, Gd, Tb)$MgB_5O_{10}$:Mn, and $GdMgB_5O_{10}$:Ce, Tb can be used as the borate phosphor having another composition ratio.

(8) Phosphate-borate phosphor: $2(M_{(1-x)}M'_x)O.aP_2\ O_5.bB_2O_3$(M is at least one element that is selected from a group consisting of Mg, Ca, Sr, Ba, and Zn, M' is at least one element that is selected from a group consisting of Eu, Mn, Sn, Fe, and Cr, and x, a, and b are numerical values satisfying $0.001 \leqq x \leqq 0.5$, $0 \leqq a \leqq 2$, $0 \leqq b \leqq 3$, and $0.3<(a+b)$)

(9) Phosphate phosphor: $(Sr_{(1-x)}Ba_x)_3\ (PO_4)_2$:Eu or $(Sr_{(1-x)}Ba_x)_2P_2O_7$:Eu, Sn At least one of Ti and Cu may be contained as the activation agent.

(10) Halophosphate phosphor: $(M_{(1-x)}Eu_x)_{10}\ (PO_4)_6Cl_2$ or $(M_{(1-x)}Eu_x)_5\ (PO_4)_3Cl$ (M is at least one element that is selected from a group consisting of Ba, Sr, Ca, Mg, and Cd, and x is a numerical value satisfying $0 \leqq x \leqq 1$)

At least part of Cl may be substituted for fluorine (F). At least one of Sb and Mn may be contained as the activation agent.

What is claimed is:

1. A light emitting device comprising:

a substrate;

a semiconductor laser diode to emit a laser beam, the semiconductor laser diode is provided in contact with the substrate;

a luminescent component being separated from the semiconductor laser diode and from the substrate, the luminescent component having a recess, the luminescent component absorbing the laser beam incident to the recess to emit white light, the luminescent component includes phosphors, the luminescent component has a structure in which a plurality of luminescent composites each containing different kinds of phosphors are concentrically stacked into a spherical shape, and a center of the spherical shape coincides with the bottom of the recess; and a transparent cover attached to the substrate and to cover the luminescent component with a space between the transparent cover and the luminescent component, wherein the device illuminates a backside of the device with white light in addition to a front side.

2. The device according to claim 1, further comprising a light guide component being provided between the laser diode and the luminescent component, a leading end of the light guide component being inserted in the recess.

3. The device according to claim 1, further comprising an optical lens to collect the laser beam being provided between the semiconductor laser diode and the luminescent component.

4. The device according to claim 1, further comprising a light diffusion composite in a center portion of the luminescent component.

5. The device according to claim 1, wherein the luminescent component is made of a luminescent composite in which at least one kind of phosphors are dispersed in a transparent resin, inorganic glass, or a crystal.

6. The device according to claim 2, wherein the light guide component is an optical fiber including a core layer made of plastic or quartz glass and a cladding layer made of plastic or quartz glass.

7. The device according to claim 2, wherein the light guide component has a rod shape.

8. The device according to claim 1, wherein the semiconductor laser diode is provided at an outside of the recess.

9. The device according to claim 1, wherein an outer surface of the luminescent component other than the recess is exposed to the space between the transparent cover and the luminescent component.

10. The device according to claim 2, wherein the leading end of the light guide component is formed so as to be located in a center portion of the luminescent component.

* * * * *